US010107115B2

(12) United States Patent
Alvanos

(10) Patent No.: US 10,107,115 B2
(45) Date of Patent: Oct. 23, 2018

(54) GAS TURBINE ENGINE COMPONENT HAVING TIP VORTEX CREATION FEATURE

(71) Applicant: UNITED TECHNOLOGIES CORPORATION, Hartford, CT (US)

(72) Inventor: Ioannis Alvanos, West Springfield, MA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 261 days.

(21) Appl. No.: 14/764,760

(22) PCT Filed: Jan. 31, 2014

(86) PCT No.: PCT/US2014/013979

§ 371 (c)(1),
(2) Date: Jul. 30, 2015

(87) PCT Pub. No.: WO2014/175936

PCT Pub. Date: Oct. 30, 2014

(65) Prior Publication Data

US 2015/0369071 A1 Dec. 24, 2015

Related U.S. Application Data

(60) Provisional application No. 61/760,817, filed on Feb. 5, 2013.

(51) Int. Cl.
*F01D 9/04* (2006.01)
*F01D 11/00* (2006.01)
(Continued)

(52) U.S. Cl.
CPC ..... *F01D 9/041* (2013.01); *F01D 11/001* (2013.01); *F04D 29/164* (2013.01);
(Continued)

(58) Field of Classification Search
CPC ..... F01D 9/041; F01D 5/01; F01D 11/001; F01D 25/24; F02C 3/06; F02C 3/14; F05D 2220/32; F05D 2240/12; F05D 2250/61
See application file for complete search history.

(56) References Cited

U.S. PATENT DOCUMENTS 2,675,174 A * 4/1954 Wheatley ..... F01D 5/06 415/190
3,042,365 A * 7/1962 Curtis ..... F01D 11/125 277/414
(Continued)

FOREIGN PATENT DOCUMENTS

EP 0718469 A1 6/1996
EP 1555392 A2 7/2005
(Continued)

OTHER PUBLICATIONS

International Preliminary Report on Patentability for International application No. PCT/US2014/013979 dated Aug. 20, 2015.
(Continued)

*Primary Examiner* — Patrick Maines
(74) *Attorney, Agent, or Firm* — Carlson, Gaskey & Olds, P.C

(57) ABSTRACT

A component for a gas turbine engine according to an exemplary aspect of the present disclosure includes, among other things, a static structure that extends between a radially outer portion and a radially inner portion and at least one vortex creation feature formed on the static structure.

7 Claims, 4 Drawing Sheets

(51) Int. Cl.
*F04D 29/16* (2006.01)
*F04D 29/54* (2006.01)
*F01D 5/20* (2006.01)

(52) U.S. Cl.
CPC ..... *F04D 29/544* (2013.01); *F01D 5/20* (2013.01); *F05D 2220/32* (2013.01); *F05D 2240/125* (2013.01); *F05D 2240/127* (2013.01); *F05D 2240/129* (2013.01); *F05D 2250/18* (2013.01); *F05D 2250/182* (2013.01); *F05D 2250/183* (2013.01); *F05D 2250/294* (2013.01)

(56) References Cited

U.S. PATENT DOCUMENTS 5,167,486 A * 12/1992 Detanne ..... F01D 1/02 415/115
5,562,404 A 10/1996 Koff et al.
5,950,308 A 9/1999 Koff et al.
6,004,095 A 12/1999 Waitz et al.
7,195,453 B2 3/2007 Martin et al.
7,241,108 B2 7/2007 Lewis
7,445,213 B1 * 11/2008 Pelfrey ..... F01D 11/02 277/418
8,038,388 B2 10/2011 Freling et al.
2005/0111967 A1 5/2005 Couture et al.
2008/0219835 A1 9/2008 Freling et al.
2008/0232949 A1 * 9/2008 Reichert ..... F01D 11/02 415/1
2011/0070072 A1 3/2011 Subramaniyan
2011/0163505 A1 * 7/2011 Bhagavatheeswaran ..... F01D 11/02 277/303
2011/0250073 A1 * 10/2011 Neeli ..... F01D 11/001 416/223 R
2014/0023487 A1 * 1/2014 Dougan ..... F01D 25/243 415/144
2014/0064909 A1 * 3/2014 Trivedi ..... F01D 11/001 415/1

FOREIGN PATENT DOCUMENTS

EP 1930551 A2 * 6/2008 ..... F01D 11/001
EP 2 309 098 A1 4/2011
EP 2390466 A1 11/2011

OTHER PUBLICATIONS

International Search Report and Written Opinion of the International Searching Authority for International application No. PCT/US2014/013979 dated Nov. 21, 2014.
Extended European Search Report for Application No. EP 14 78 8627 dated Oct. 11, 2016.

* cited by examiner

GAS TURBINE ENGINE COMPONENT HAVING TIP VORTEX CREATION FEATURE

BACKGROUND

This disclosure relates to a gas turbine engine, and more particularly to a component having at least one tip vortex creation feature.

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

Each of the compressor section and the turbine section may include multiple stages. Each stage typically includes alternating rows of rotating structures called rotor blades followed by stationary structures called stators. The rotor blades create or extract energy (in the form of pressure) from the core airflow that is communicated through the gas turbine engine. The stators direct the core airflow to the blades to either add or extract energy.

Some gas turbine engines incorporate cantilevered stator designs. Cantilevered stators include a stationary structure that is affixed at a radially outer portion and unsupported at a radially inner portion. A portion of a rotating structure surrounds a tip of each cantilevered stator. A clearance may extend between the tip and the rotating structure. Gas turbine engine efficiency may depend on minimizing this clearance.

SUMMARY

A component for a gas turbine engine according to an exemplary aspect of the present disclosure includes, among other things, a static structure that extends between a radially outer portion and a radially inner portion and at least one vortex creation feature formed on the static structure.

In a further non-limiting embodiment of the foregoing component for a gas turbine engine, the component is a cantilevered stator.

In a further non-limiting embodiment of either of the foregoing components for a gas turbine engine, the cantilevered stator is a compressor cantilevered stator.

In a further non-limiting embodiment of any of the foregoing components for a gas turbine engine, the cantilevered stator is a turbine cantilevered stator.

In a further non-limiting embodiment of any of the foregoing components for a gas turbine engine, the at least one vortex creation feature is formed on a tip of the cantilevered stator.

In a further non-limiting embodiment of any of the foregoing components for a gas turbine engine, the at least one vortex creation feature includes a plurality of serrations.

In a further non-limiting embodiment of any of the foregoing components for a gas turbine engine, the at least one vortex creation feature includes a plurality of teeth.

In a further non-limiting embodiment of any of the foregoing components for a gas turbine engine, the at least one vortex creation feature includes a plurality of grooves.

In a further non-limiting embodiment of any of the foregoing components for a gas turbine engine, the at least one vortex creation feature includes a combination of at least one serration, tooth and groove.

In a further non-limiting embodiment of any of the foregoing components for a gas turbine engine, the at least one vortex creation feature establishes a tortuous flow path between a tip of the static structure and a rotating structure surrounding the tip.

A gas turbine engine according to an exemplary aspect of the present disclosure includes, among other things, a first stage of cantilevered stators and a second stage of cantilevered stators disposed downstream from the first stage of cantilevered stators. The first stage of cantilevered stators includes first vortex creation features and the second stage of cantilevered stators includes second vortex creation features.

In a further non-limiting embodiment of the foregoing gas turbine engine, the first vortex creation features and the second vortex creation features include one of a serration, a tooth and a groove.

In a further non-limiting embodiment of either of the foregoing gas turbine engines, each of the first stage of cantilevered stators and the second stage of cantilevered stators include a plurality of static structures that extend between a radially outer portion and a radially inner portion.

In a further non-limiting embodiment of any of the forgoing gas turbine engines, a tip is located at the radially inner portion of each of the plurality of static structures. The first vortex creation features and the second vortex creation features are formed on the tips.

In a further non-limiting embodiment of any of the forgoing gas turbine engines, the first vortex creation features are different from the second vortex creation features.

A method of operating a gas turbine engine according to another exemplary aspect of the present disclosure includes, among other things, forcing an airflow to bypass a tip clearance between a static structure and a rotating structure of the gas turbine engine by generating flow vortices within the tip clearance.

In a further non-limiting embodiment of the foregoing method, the method includes the step of providing at least one vortex creation feature on a tip of the static structure.

In a further non-limiting embodiment of any of the foregoing methods, the step of forcing airflow includes generating a tortuous flow path at a tip of the static structure.

In a further non-limiting embodiment of any of the foregoing methods, the step of generating the tortuous flow path includes providing at least one vortex creation feature on the tip of the static structure.

In a further non-limiting embodiment of any of the foregoing methods, the step of forcing airflow includes forcing the airflow across a portion of the static structure that is radially outward from a tip of the static structure.

The various features and advantages of this disclosure will become apparent to those skilled in the art from the following detailed description. The drawings that accompany the detailed description can be briefly described as follows.

DETAILED DESCRIPTION

Figure 1:
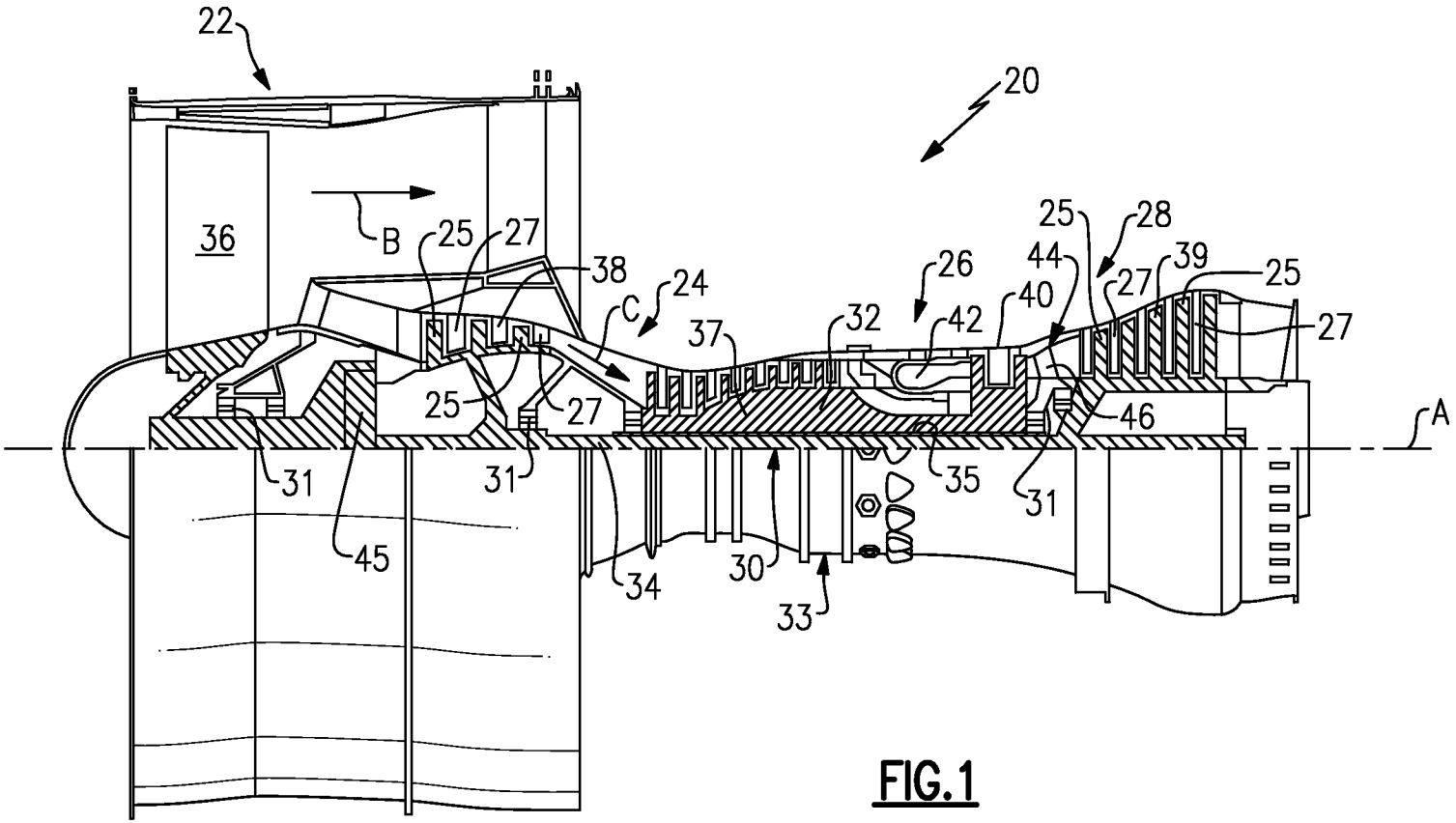
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}°\text{R})/(518.7°\ \text{R})]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and stator assemblies (shown schematically) that carry airfoils that extend into the core flow path C. For example, the rotor assemblies can carry a plurality of rotating blades 25, while each vane assembly can carry a plurality of stators 27 that extend into the core flow path C. The blades 25 create or extract energy (in the form of pressure) from the core airflow that is communicated through the gas turbine engine 20 along the core flow path C. The stators 27 direct the core airflow to the blades 25 to either add or extract energy.

This disclosure relates to tip vortex creation features that may be incorporated into one or more components of the gas turbine engine 20. Among other benefits, the exemplary tip vortex creation features can increase gas turbine engine efficiency.

Figure 2:
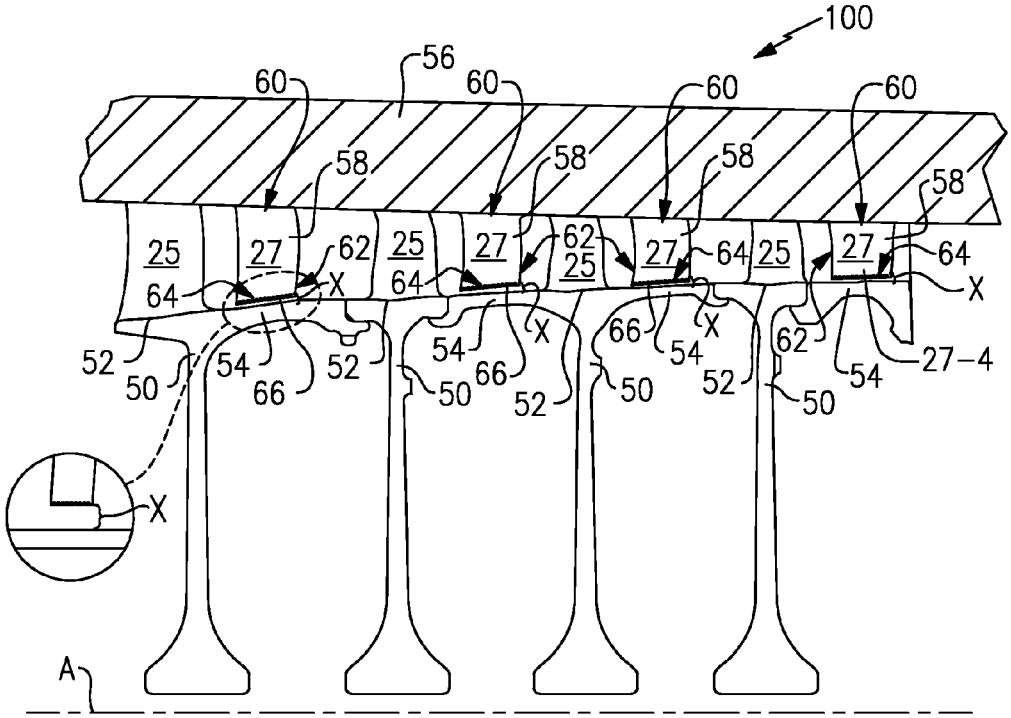
FIG. 2 illustrates a cross-sectional view of a section that can be incorporated into a gas turbine engine.

FIG. 2 illustrates a portion 100 of a gas turbine engine, such as the gas turbine engine 20. In this embodiment, the portion 100 is part of the compressor section 24 of the gas turbine engine 20. However, this disclosure is not limited to the compressor section 24, and the various features identified in this disclosure could extend to other sections of the gas turbine engine 20, including but not limited to the turbine section 28.

The portion 100 includes multiple stages of alternating rows of rotating rotor blades 25 and stationary stators 27. Each row of rotor blades 25 and stators 27 is circumferentially disposed about the engine centerline longitudinal axis A. Although four stages are depicted, it should be understood that the portion 100 could include a greater or fewer number of stages. The rotor blades 25 are attached to rotating structures 50, such as disks, that rotate about the engine centerline longitudinal axis A to move the rotor blades 25. Each rotating structure 50 includes a rim 52 that supports one or more rotor blades 25. The rotating structure 50 may additionally include a sealing structure 54, such as a rotor seal land or other rotating structure, which extends between the rims 52 of adjacent rotor blades 25.

In this exemplary embodiment, the stators 27 are cantilevered stators. That is, the stators 27 include a static structure 58 that extends into the core flow path C. In one embodiment, the static structure 58 is an airfoil. Each static structure 58 may be affixed to an engine casing 56 at a radially outer portion 60 and is unsupported at a radially inner portion 62. A tip 64 of the radially inner portion 62 of the static structure 58 is disposed adjacent to the rotating structure 50. In one embodiment, the sealing structure 54 surrounds the tips 64. A clearance X extends across the open space between the tip 64 and the rotating structure 50.

One or more of the static structures 58 may include tips 64 having at least one vortex creation feature 66 that is formed on the tips 64 of the stators 27. At least one of the stages of the stators 27 may exclude any vortex creation features 66. For example, in this embodiment, a fourth stage of stators 27-4 is formed without vortex creation features 66 at the tips 64.

Figure 3:
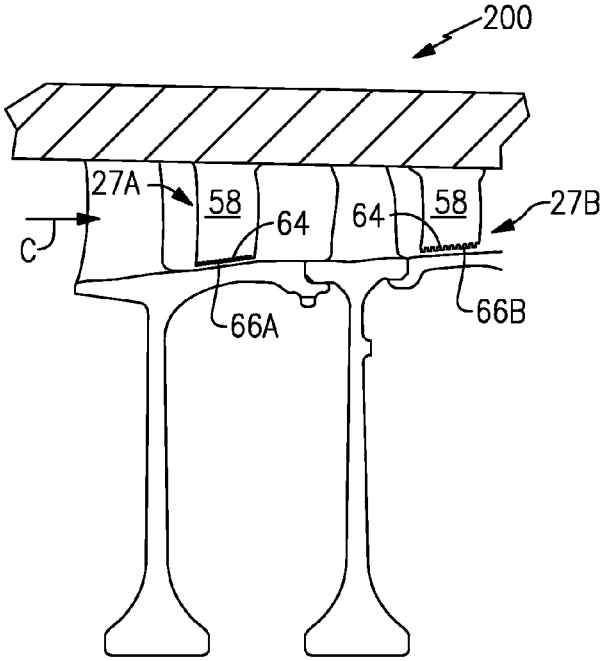
FIG. 3 illustrates another section that can be incorporated into a gas turbine engine.

FIG. 3 illustrates another portion 200 that can be incorporated into a gas turbine engine, such as the gas turbine engine 20. In this embodiment, the portion 200 includes a first stage of cantilevered stators 27A and a second stage of cantilevered stators 27B disposed downstream from the first stage of cantilevered stators 27A. The first stage of cantilevered stators 27A may include first vortex creation features 66A formed at the tips 64 of each static structure 58. The second stage of cantilevered stators 27B may include second vortex creation features 66B formed at the tips 64 of each static structure. In one embodiment, the second vortex creation features 66B are different from the first vortex creation features 66A. That is, the first and second vortex creation features 66A, 66B may embody different design characteristics. In this manner, the portion 200 can be designed to provide an improved pressure distribution across the core flow path C.

Figure 4A:
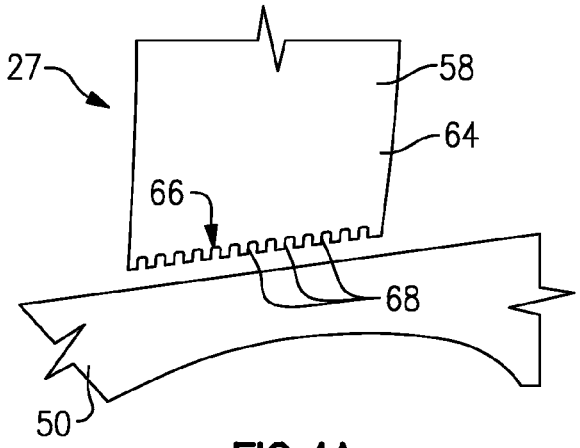
FIGS. 4A, 4B and 4C illustrate embodiments of tip vortex creation features that can be incorporated into a gas turbine engine component.
Figure 4B:
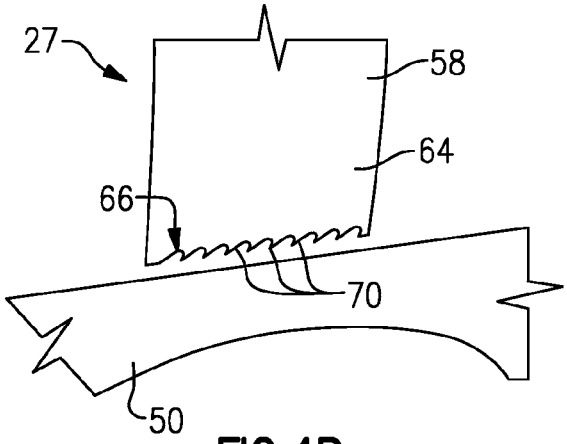
Figure 4C:
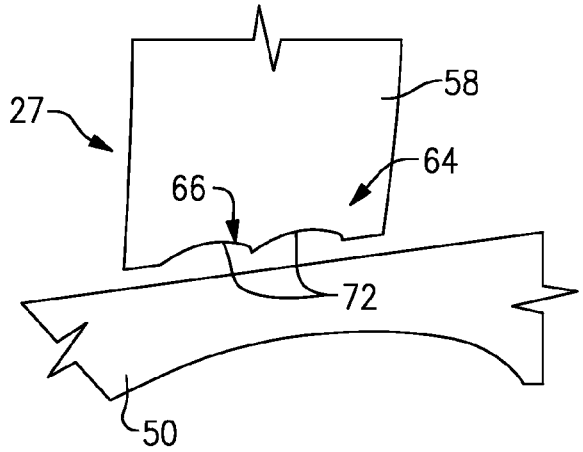

FIGS. 4A, 4B and 4C illustrate various design features that can be incorporated into a static structure 58 of a stator 27. Each static structure 58 includes a tip 64 that may incorporate at least one vortex creation feature 66. Each tip 64 can include one or more vortex creation features 66. A rotating structure 50 generally surrounds the tips 64 of each static structure 58. In one non-limiting embodiment, the vortex creation features 66 are formed on a distal-most portion of the tips 64.

Referring to FIG. 4A, the at least one vortex creation feature 66 includes a plurality of serrations 68. The vortex creation feature(s) 66 could alternatively include a plurality of teeth 70, such as illustrated by FIG. 4B. In another embodiment, the vortex creation feature(s) 66 include grooves 72 (see FIG. 4C). In yet another embodiment, the vortex creation features 66 include a combination of serrations, teeth and/or grooves. The actual design of the vortex creation features 66 can vary depending upon design specific parameters that include, but are not limited to, core size, flow rates, pressure ratios and other gas turbine engine specific parameters.

Figure 5:
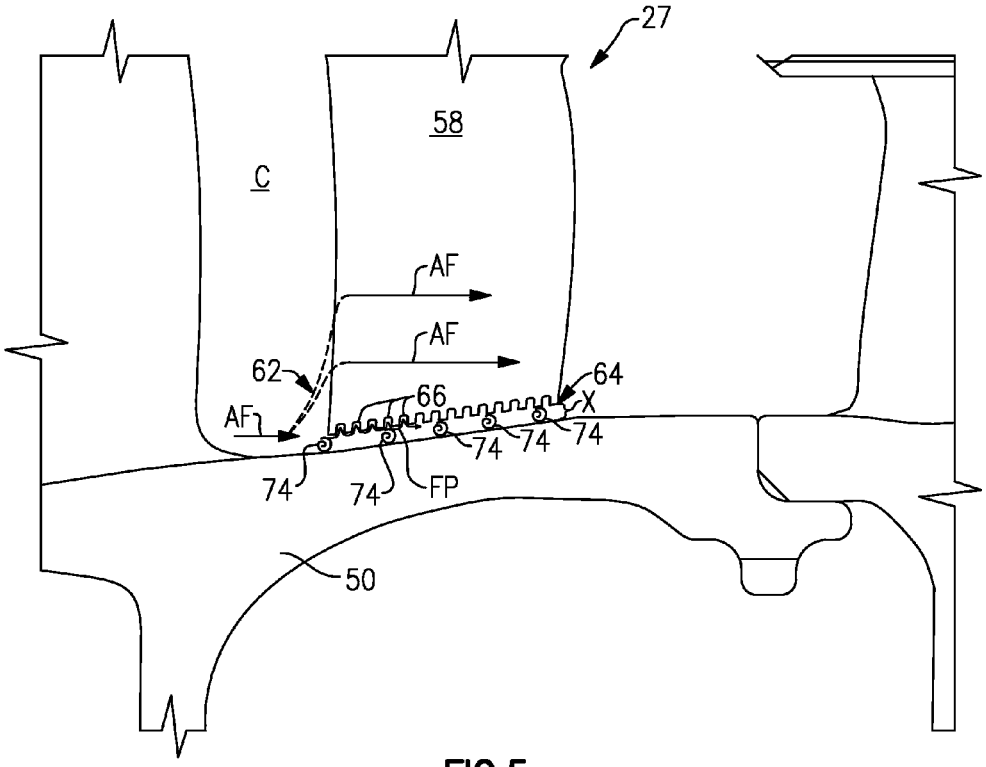
FIG. 5 illustrates an exemplary cantilevered stator that can be incorporated into a gas turbine engine.

FIG. 5 illustrates an exemplary cantilevered stator 27. The cantilevered stator 27 includes a static structure 58 having a tip 64 at a radially inner portion 62 thereof. A rotating structure 50 generally surrounds the tip 64 such that a clearance X extends between the tip 64 and the rotating structure 50. It should be understood that the clearance X is shown significantly larger than in practice to better illustrate the interaction between the tip 64 and the rotating structure 50, among other features. A plurality of vortex creation features 66 can be formed on the tip 64. The vortex creation features 66 establish a tortious flow path FP between the tip 64 and the rotating structure 50. Multiple flow vortices 74 may be formed within the tortious flow path FP as airflow AF attempts to flow through the clearance X.

The flow vortices 74 that are generated within the clearance X force the airflow AF to bypass the clearance X between the tip 64 and the rotating structure 50. The airflow AF is instead forced across a portion of the static structure 58 that is radially outward from the tip 64. In other words, incorporating the vortex creation features 66 into the tip 64 results in the creation of pockets of local turbulent flow vortices 74 that force more airflow AF to pass over the static structure 58 residing in the core flow path C, thereby improving gas turbine engine efficiency through effective tip clearance control. Efficiency benefits may occur based on a higher percentage of flow path airflow being forced onto the static structure 58 to be guided and directed towards the next stage to minimize flow path turbulence.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A gas turbine engine, comprising:

a first stage of cantilevered stators;

a second stage of cantilevered stators disposed downstream from said first stage of cantilevered stators, wherein said first stage of cantilevered stators includes first vortex creation features and said second stage of cantilevered stators includes second vortex creation features, at least one of the first vortex creation features and the second vortex creation features including at least one serration, the at least one serration including a slanted protrusion that tapers to a pointed end;

wherein each of said first stage of cantilevered stators and said second stage of cantilevered stators include a plurality of static structures that extend between a radially outer portion and a radially inner portion;

a tip at said radially inner portion of each of said plurality of static structures, wherein said first vortex creation features and said second vortex creation features are formed on said tips; and wherein the first stage and the second stage are located in a section of the gas turbine engine, the section including a third stage of cantilevered stators that excludes any vortex creation features.

2. The gas turbine engine as recited in claim 1, wherein each of said first vortex creation features and said second vortex creation features include one of the at least one serration, a tooth and a groove.

3. The gas turbine engine as recited in claim 1, wherein said first vortex creation features are different from said second vortex creation features.

4. The gas turbine engine as recited in claim 1, wherein the first vortex creation features include the at least one serration, the at least one serration being a plurality of serrations, and the second vortex creation features include a plurality of teeth that each terminate at a flat outer end.

5. The gas turbine engine as recited in claim 4, wherein each of the first vortex creation features and the second vortex creation features establishes a tortuous flow path between a respective one of the tips and a rotating structure.

6. The gas turbine engine as recited in claim 1, wherein the first stage and the second stage are located in a compressor section.

7. The gas turbine engine as recited in claim 1, the first stage and the second stage are located in a turbine section.

* * * * *